US005829397A

United States Patent [19]

Vorih et al.

[11] Patent Number: 5,829,397

[45] Date of Patent: Nov. 3, 1998

[54] SYSTEM AND METHOD FOR CONTROLLING THE AMOUNT OF LOST MOTION BETWEEN AN ENGINE VALVE AND A VALVE ACTUATION MEANS

[75] Inventors: Joseph Vorih, West Suffield; Haoran Hu, Farmington, both of Conn.

[73] Assignee: Diesel Engine Retarders, Inc., Wilmington, Del.

[21] Appl. No.: 701,451

[22] Filed: Aug. 22, 1996

Related U.S. Application Data

[63] Continuation-in-part of Ser. No. 512,528, Aug. 8, 1995, abandoned.

[51] Int. Cl.[6] ..... F01L 9/02; F01L 13/00

[52] U.S. Cl. ..... 123/90.12; 123/90.16; 123/90.22; 123/198 D; 123/321

[58] Field of Search ..... 123/90.11, 90.12, 123/90.15, 90.16, 90.22, 90.27, 90.36, 90.39, 90.4, 90.45, 90.46, 90.48, 90.55, 90.61, 198 D, 320, 321, 322, 323

[56] References Cited

U.S. PATENT DOCUMENTS

| | | | |
|---|---|---|---|
| 2,923,282 | 2/1960 | White | 123/90.45 |
| 3,220,392 | 11/1965 | Cummins | 123/321 |
| 3,809,033 | 5/1974 | Cartledge | 123/90.46 |
| 4,151,824 | 5/1979 | Gilbert | 123/90.61 |
| 4,572,114 | 2/1986 | Sickler | 123/21 |
| 4,655,177 | 4/1987 | Wells et al. | 123/90.36 |
| 4,664,070 | 5/1987 | Meistrick et al. | 123/21 |
| 4,796,573 | 1/1989 | Wakeman et al. | 123/90.16 |
| 4,887,562 | 12/1989 | Wakeman | 123/90.16 |
| 5,000,145 | 3/1991 | Quenneville | 123/90.16 |
| 5,002,022 | 3/1991 | Perr | 123/90.16 |
| 5,095,861 | 3/1992 | Dove, Jr, | 123/90.39 |
| 5,113,811 | 5/1992 | Rembold et al. | 123/90.16 |
| 5,113,812 | 5/1992 | Rembold et al. | 123/90.12 |
| 5,127,375 | 7/1992 | Bowman et al. | 123/90.16 |
| 5,146,890 | 9/1992 | Gobert et al. | 123/321 |
| 5,154,143 | 10/1992 | Stutzenberger | 123/90.16 |
| 5,225,641 | 7/1993 | Schechter | 123/90.12 |
| 5,263,441 | 11/1993 | Rembold et al. | 123/90.16 |
| 5,325,825 | 7/1994 | Schmidt et al. | 123/90.39 |
| 5,379,737 | 1/1995 | Hu | 123/322 |
| 5,451,029 | 9/1995 | Kruger | 123/90.12 |
| 5,609,133 | 3/1997 | Hakansson | 123/90.16 |
| 5,622,146 | 4/1997 | Speil | 123/90.4 |

*Primary Examiner*—Weilun Lo

*Attorney, Agent, or Firm*—Collier, Shannon, Rill & Scott; Patrick J. Coyne

[57] ABSTRACT

An internal combustion engine lost motion valve actuation system is disclosed. The system includes a variable length connection means connecting a force imparting means and an engine valve. The connection means may assume plural lengths to provide plural amounts of lost motion. The connection means may provide a maximum amount of lost motion which provides some minimum level of valve actuation suitable for a limp home operation of the engine. The connection means is operable for both engine positive power and engine braking modes of operation.

33 Claims, 11 Drawing Sheets

SYSTEM AND METHOD FOR CONTROLLING THE AMOUNT OF LOST MOTION BETWEEN AN ENGINE VALVE AND A VALVE ACTUATION MEANS

CROSS REFERENCE TO RELATED PATENT APPLICATIONS

This application is a Continuation-in-Part of prior U.S. patent application Ser. No. 08/512,528 filed Aug. 8, 1995, now abandoned, by Haoran Hu and assigned to the same assignee as the present application.

FIELD OF THE INVENTION

The present invention relates generally to systems and methods for opening valves in internal combustion engines. More specifically the invention relates to systems and methods, used both during positive power and engine braking, for controlling the amount of "lost motion" between a valve and a means for opening the valve.

BACKGROUND OF THE INVENTION

In many internal combustion engines the engine cylinder intake and exhaust valves may be opened and closed by fixed profile cams in the engine, and more specifically by one or more fixed lobes which may be an integral part of each of the cams. The use of fixed profile cams makes it difficult to adjust the timings and/or amounts of engine valve lift to optimize valve opening times and lift for various engine operating conditions, such as different engine speeds.

One method of adjusting valve timing and lift, given a fixed cam profile, has been to incorporate a "lost motion" device in the valve train linkage between the valve and the cam. Lost motion is the term applied to a class of technical solutions for modifying the valve motion proscribed by a cam profile with a variable length mechanical, hydraulic, or other linkage means. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve.

This variable length system (or lost motion system) may, when expanded fully, transmit all of the cam motion to the valve, and when contracted fully, transmit none or a minimum amount of the cam motion to the valve. An example of such a system and method is provided in co-pending U.S. application Ser. No. 08/512,528 filed Aug. 8, 1995, and in Hu U.S. Pat. No. 5,537,976, which are assigned to the same assignee as the present application, and which are incorporated herein by reference.

In the lost motion system of Applicant's co-pending application, an engine cam shaft may actuate a master piston which displaces fluid from its hydraulic chamber into a hydraulic chamber of a slave piston. The slave piston in turn acts on the engine valve to open it. The lost motion system may be a solenoid valve and a check valve in communication with the hydraulic circuit including the chambers of the master and slave pistons. The solenoid valve may be maintained in a closed position in order to retain hydraulic fluid in the circuit. As long as the solenoid valve remains closed, the slave piston and the engine valve respond directly to the motion of the master piston, which in turn displaces hydraulic fluid in direct response to the motion of a cam. When the solenoid is opened temporarily, the circuit may partially drain, and part or all of the hydraulic pressure generated by the master piston may be absorbed by the circuit rather than be applied to displace the slave piston.

Prior to the present invention, lost motion systems have not had the combined capability of providing an adequate fail-safe or "limp home" mode of operation and of providing variable degrees of valve lift over an entire range of cam lobe positions. In previous lost motion systems, a leaky hydraulic circuit could disable the master piston's ability to open its associated valve(s). If a large enough number of valves cannot be opened at all, the engine cannot be operated. Therefore, it is important to provide a lost motion system which enables the engine to operate at some minimum level (i.e. at a limp home level) should the hydraulic circuit of such a system develop a leak. A limp home mode of operation may be provided by using a lost motion system which still transmits a portion of the cam motion through the master and slave pistons and to the valve after the hydraulic circuit therefor leaks or the control thereof is lost. In this manner the most extreme portions of a cam profile can still be used to get some valve actuation after control over the variable length of the lost motion system is lost and the system has contracted to a minimum length. The foregoing assumes of course that the lost motion system is constructed such that it will assume a fully contracted position should control over it be lost and that the valve train will provide the minimum valve actuation necessary to operate the engine when the system is fully contracted. In this manner the lost motion system may be designed to allow the engine to operate, albeit not optimally, so that an operator can still "limp home" and make repairs.

Kruger, U.S. Pat. No. 5,451,029 (Sep. 19, 1995), for a Variable Valve Control Arrangement, assigned to Volkswagen AG, discloses a lost motion system which when fully contracted may provide some valve actuation. Kruger does not, however, disclose that the lost motion system may be designed such as to provide limp home capability. Kruger rather discloses a lost motion system which starts from a fully contracted position upon every cycle of the engine. The lost motion system thereby provides a base level of valve actuation when fully contracted, such base level being modifiable only after the lost motion system has been displaced a predetermined distance. It follows therefore that the Kruger lost motion system is undesirably limited to starting from a fully contracted position each engine cycle and cannot vary the amount of lost motion until after the lost motion system has been displaced by a cam motion.

Previous lost motion systems have typically not utilized high speed mechanisms to rapidly vary the length of the lost motion system. Lost motion systems of the prior art have accordingly not been variable such that they may assume more than one length during a single cam lobe motion, or even during one cycle of the engine. By using a high speed mechanism to vary the length of the lost motion system, more precise control may be attained over valve actuation, and accordingly optimal valve actuation may be attained for a wide range of engine operating conditions.

Applicant has determined that the lost motion system and method of the present invention may be particularly useful in engines requiring valve actuation for both positive power and for compression release retarding and exhaust gas recirculation valve events. Typically, compression release and exhaust gas recirculation events involve much less valve lift than do positive power related valve events. Compression release and exhaust gas recirculation events may however require very high pressures and temperatures to occur in the engine. Accordingly, if left uncontrolled (which may occur with the failure of a lost motion system), compression release and exhaust gas recirculation could result in pressure or temperature damage to an engine at higher operating speeds. Therefore, Applicant has determined that it may be beneficial to have a lost motion system which is capable of providing control over positive power, compression release, and exhaust gas recirculation events, and which will provide only positive power or some low level of compression release and exhaust gas recirculation valve events, should the lost motion system fail.

An example of a lost motion system and method used to obtain retarding and exhaust gas recirculation is provided by the Gobert, U.S. Pat. No. 5,146,890 (Sep. 15, 1992) for a Method And A Device For Engine Braking A Four Stroke Internal Combustion Engine, assigned to AB Volvo, and incorporated herein by reference. Gobert discloses a method of conducting exhaust gas recirculation by placing the cylinder in communication with the exhaust system during the first part of the compression stroke and optionally also during the latter part of the inlet stroke. Gobert uses a lost motion system to enable and disable retarding and exhaust gas recirculation, but such system is not variable within an engine cycle.

None of the lost motion systems or methods of the prior art have enabled precise control of valve actuation to optimize valve movement for different engine operating conditions, while maintaining an acceptable limp home capability. Furthermore, none of the lost motion systems or methods of the prior art disclose, teach or suggest the use of a high speed lost motion system capable of varying the amount of lost motion during a valve event such that the system independently controls valve opening and closing times, while maintaining an acceptable limp home capability. Such independent control may be realized by modifying a standard cam lobe initiated valve opening event with precise amounts of lost motion, which may range between a minimum and maximum amount at different times during the valve event. In addition, none of the prior art discloses, teaches or suggests any system or method for defaulting to a predetermined level of positive power valve actuation (which may or may not include some exhaust gas recirculation) should control of a lost motion system be lost.

Accordingly, there is a significant need for a system and method of controlling lost motion which: (i) optimizes engine operation under various engine operating conditions; (ii) provides precise control of lost motion; (iii) provides acceptable limp home capability; and (iv) provides for high speed variation of the length of a lost motion system.

OBJECTS OF THE INVENTION

It is therefore an object of the present invention to provide a system and method for optimizing engine operation under various engine operating conditions by valve actuation control.

It is a further object of the present invention to provide a system and method for providing precise control of the lost motion in a valve train.

It is another object of the present invention to provide a system and method for limiting the amount of lost motion provided by a lost motion system.

It is a further object of the present invention to provide a system and method for controlling the amount of lost motion provided by a lost motion system.

It is still a further object of the present invention to provide a system and method of valve actuation which provides a limp home capability.

It is yet another object of the present invention to provide a system and method for achieving variation of the length of a lost motion system.

It is still yet another object of the invention to provide a system and method for limiting the amount of motion that may be lost by a lost motion system.

It is yet a further object of the invention to provide a system and method for selectively actuating a valve with a lost motion system for positive power, compression release retarding, and exhaust gas recirculation modes of operation.

It is still a further object of the invention to provide a system and method for valve actuation which is compact and light weight.

SUMMARY OF THE INVENTION

In response to this challenge, Applicants have developed an innovative and reliable system and method to achieve control of an engine valve using lost motion. In accordance with the teachings of the present invention, the present invention is, an internal combustion engine lost motion valve actuation system, comprising a variable length connection means for transmitting a valve actuation force from a force source to a valve, said connection means being adapted to assume a predetermined minimum length for providing a minimum valve opening event which is greater than zero; and a high speed control means for controlling the length of the variable length connection means, said control means being adapted to vary the length of the connection means one or more times per cycle of said engine.

In an alternate embodiment the invention is a method of controlling the amount of lost motion between a means for opening an engine cylinder valve and a valve during engine braking, comprising the steps of (a) providing hydraulic fluid to an internal expansible chamber of a variable length tappet; and (b) selectively bleeding hydraulic fluid from the expansible chamber to decrease the amount of hydraulic fluid in the chamber and decrease the length of the tappet, to thereby increase the amount of lost motion between the means for opening and the valve, wherein the step of selectively bleeding is controlled such that the amount of hydraulic fluid in the chamber may be varied one or more times per cycle of the engine.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

DETAILED DESCRIPTION OF THE PREFERRED EMBODIMENTS

Figure 1:
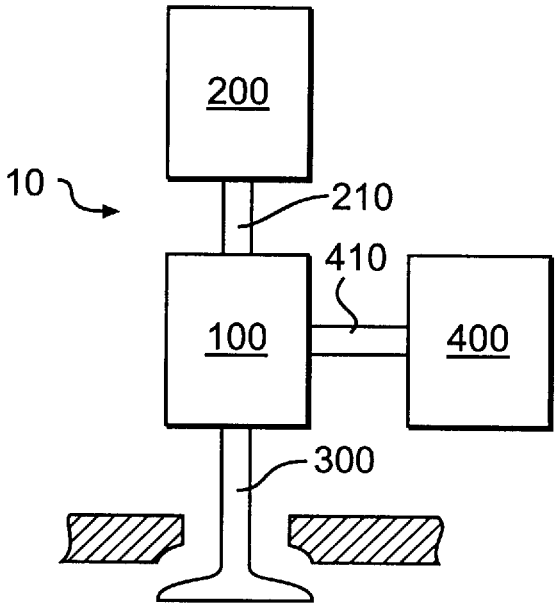
FIG. 1 is a schematic representation of an embodiment of the invention

A first embodiment of the present invention is shown in FIG. 1 as a valve actuation system 10. The valve actuation system 10 may include a hydraulic linkage comprising a lost motion system or variable length connecting system 100 which connects a force imparting system 200 with an engine valve 300. The length of the variable length connecting system may be controlled by a controller system 400.

The variable length connecting system 100 may comprise any means for transmitting a force between the force imparting system 200 and the valve 300, which can be varied between plural operative lengths. Preferably the variable length connecting system 100 may be limited to a minimum operative length which enables some minimum force to be transmitted between the force imparting means 200 and the valve 300. The variable length connecting system 100 may be connected to the force imparting system through any force transmission means 210, such as a mechanical linkage, a hydraulic circuit, a hydro-mechanical linkage, and/or an electromechanical linkage, for example. Furthermore, it should be appreciated that the variable length connecting system 100 may be located at any point in the valve train connecting the force imparting system 200 and the valve 300.

The force imparting system 200 may comprise any engine or vehicle component from which a force may be derived, or even from which a cyclical signal may be derived to control actuation of a stored force. The force imparting system 200 may include a cam in a preferred embodiment, however the invention need not be limited to a cam driven design in order to be operative.

The controller 400 may comprise any electronic or mechanically actuated means for selecting the length of the variable length system 100. The controller 400 may include a microprocessor, linked to other engine components, to determine and select the appropriate length of the variable length system 100. Valve actuation may be optimized at plural engine speeds by controlling the length of the variable length system 100 based upon information collected at the microprocessor from engine components.

The controller 400 may be connected to and/or in communication with the variable length system 100 via an control link 410. The control link 410 may be embodied by any one of numerous communication schemes, including but not limited to, a hard-wired electrical connection, a hydraulic connection, a mechanical connection, a wireless radio connection, and/or any combination of the foregoing. Preferably, the controller 400 may comprise a "high speed" device capable of varying the length of the variable length system 100, one or more times per cycle of the engine in which the valve actuation system 10 is installed.

Using the controller 400, the valve actuation system 10 may be controlled by selectively varying the length of the variable length system 100 to vary the amount of force and/or displacement which is transmitted from the force imparting system 200 to the valve 300. In such a way the valve actuation system may optimize engine operation under various engine operating conditions, provide precise control of the motion lost by the variable length system 100, provide acceptable limp home capability, and/or provide for high speed variation of the length of the variable length system 100.

Figure 2B:
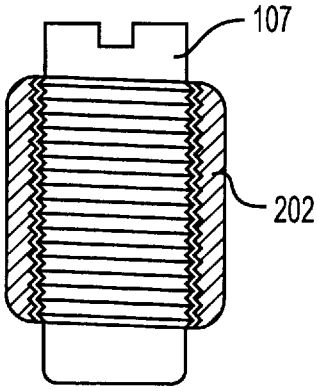
FIG. 2B is a partial cross-sectional view in elevation of an alternative embodiment of the rocker arm shown in FIG. 2A.
Figure 2A:
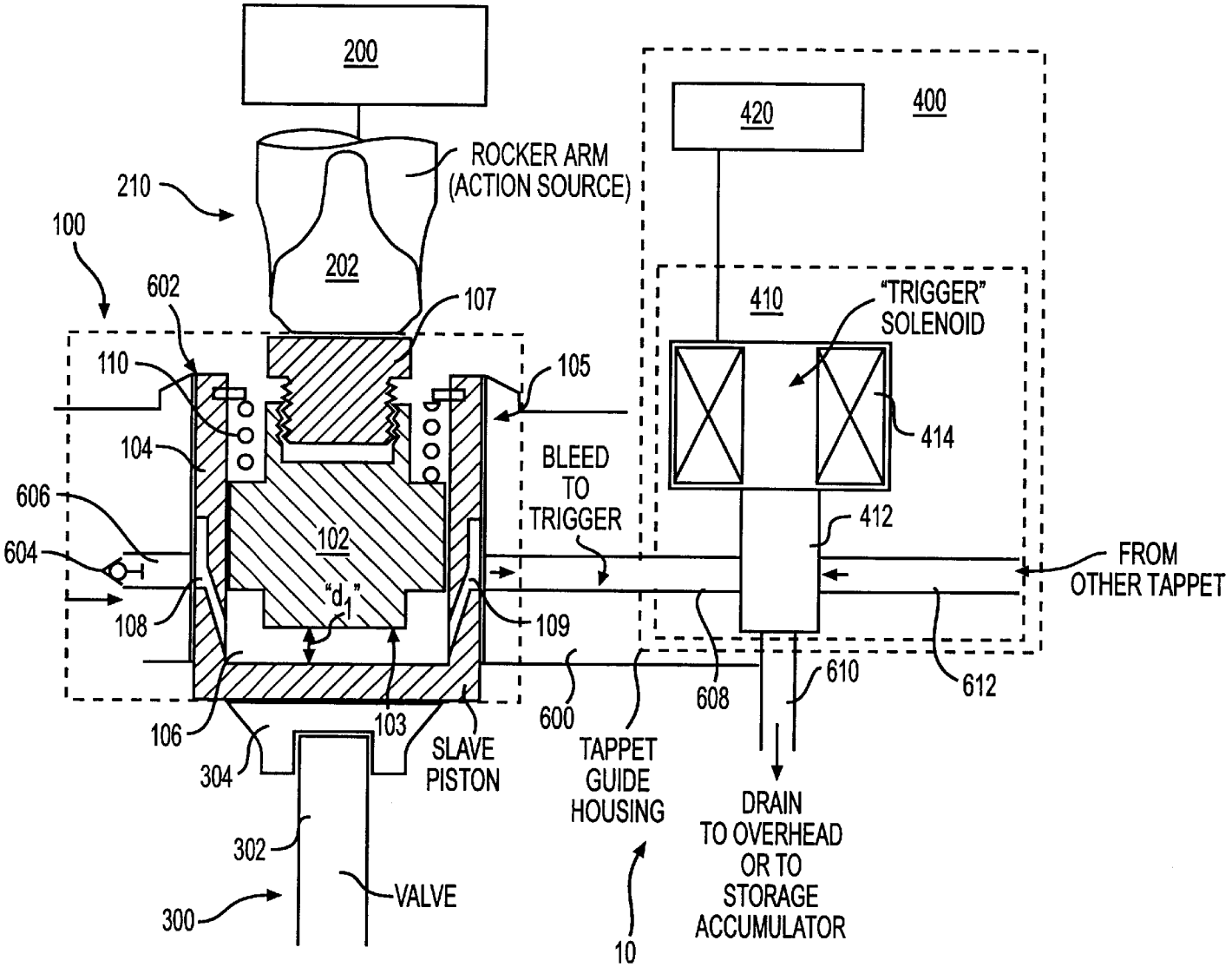
FIG. 2A is a combination schematic and cross-sectional view in elevation of a first embodiment of the invention.

A preferred embodiment of the present invention is shown in FIG. 2A as a valve actuation system 10. Like the system shown in FIG. 1, the valve actuation system 10 may include a variable length connecting system 100 which connects a force imparting system 200 with an exhaust valve 300. The length of the variable length connecting system may be controlled by controller system 400.

With continued reference to FIG. 2A, the variable length connecting system 100 may comprise a master piston 102 slidably disposed in a slave piston 104. The master piston 102 and slave piston 104 may have any complimentary cross-sectional shape, such as coaxial, concentric cylinders or ellipses, so long as the master piston is slidable within the slave piston such that a sealed chamber 106 of variable volume may be formed by the pistons.

The slave piston 104 may itself be slidably disposed in a bore 602 of a guide housing 600 mounted on an engine (not shown). The slave piston 104 may be maintained in the bore 602 by the opposing forces placed thereon by a downwardly biased rocker arm 202 and an upwardly biased valve stem 302 and valve stem end member 304. The master piston 102 and the slave piston 104 may be referred to in combination as a tappet 105. In an alternative embodiment of the invention, guide housing 600 may be an integral portion of an engine head or block and the tappet 105 may thereby be slidably disposed directly in the engine head or block.

The amount of motion lost by the variable length connector 100 may be dependent on the amount of hydraulic fluid in the sealed chamber 106. In the preferred embodiment of the invention, the hydraulic fluid may comprise engine oil used for other engine functions, such as crank shaft lubrication. The greater the amount of fluid in the chamber 106, the greater the length of the connector 100, and the less motion lost between the rocker arm 202 and the valve stem 302. If the amount of fluid in the chamber 106 is decreased, the effective length of the connector 100 may be decreased, and the amount of lost motion increased. As is apparent from FIG. 2A, the displacement of the valve 300 into an open position is inversely proportional to the amount of lost motion produced by the connector 100.

The connector 100 is sized such that when there is no fluid in chamber 106, and the master piston 102 mechanically engages the slave piston 104, the minimum length of the connector 100 still provides for the transmission of some valve opening force (i.e. some displacement) from the rocker arm 202 to the valve 300. A lash adjustment means 107 may be provided in the master piston 102 to allow lash adjustments to be made when the connector is at a minimum length. If the lash adjustment means 107 were not provided, operation of the valve actuation system 10 could result in engine damage when the connector 100 is at a minimum length, because there would be no way to make adjustments to the valve train length.

Figure 10:
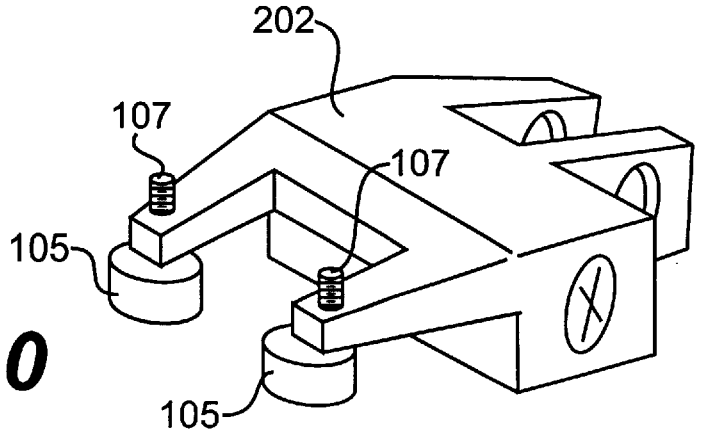
FIG. 10 is a pictorial view of an alternative embodiment of the rocker arm shown in FIG. 9.

With reference to FIG. 2B, in the preferred embodiment of the invention, a lash adjustment means 107 may be provided in the rocker arm 202, instead of in the master piston 102 as shown in FIG. 2A. Placement of the lash adjustment means 107 in the rocker arm 202 is also illustrated in FIG. 10. Lash adjustment means 107 may comprise a longitudinal threaded member which may be mechanically rotated to adjust the length of the member extending from the bottom of the rocker arm 202. Further, lash adjustment means 107 may be located anywhere in the force transmission means 210.

With renewed reference to FIG. 2A, hydraulic fluid may be provided to the slave piston 104 from a source of engine lubricant (not shown) past a check valve 604 and through one or more passages 606 in the guide housing 600. Hydraulic fluid provided by passage 606 may flow through one or more mating passages 108 in the slave piston 104 to reach the sealed chamber 106. Vertical movement of the slave piston 104, as the result of forces imparted by the rocker arm 202, may cause the passages 606 and the slave piston passages 108 to lose communication and thereby stop the flow of hydraulic fluid to the sealed chamber 106. The opening of the slave piston passage 108 may have a particular width designed to stop the flow of hydraulic fluid to the sealed chamber, and thus set a maximum length for the connector 100 that may be attained without incurring jacking of a valve head on a piston.

The master piston 102 may have a bottom surface 103 which is shaped such as to prevent the hydraulic passage 108 from losing communication with the chamber 106 even when the master piston 102 is completely contracted and the bottom surface 103 mechanically engages the slave piston 104. It may also be noted that the passage 108 is directed at an oblique angle through the slave piston so that the passage 108 will lose communication with the passage 606 as a result of movement of the slave piston 104 in the guide housing 600, but the passage 108 will not lose communication with the sealed chamber 106 as a result of movement of the master piston 102 within the slave piston 104.

Figure 3A:
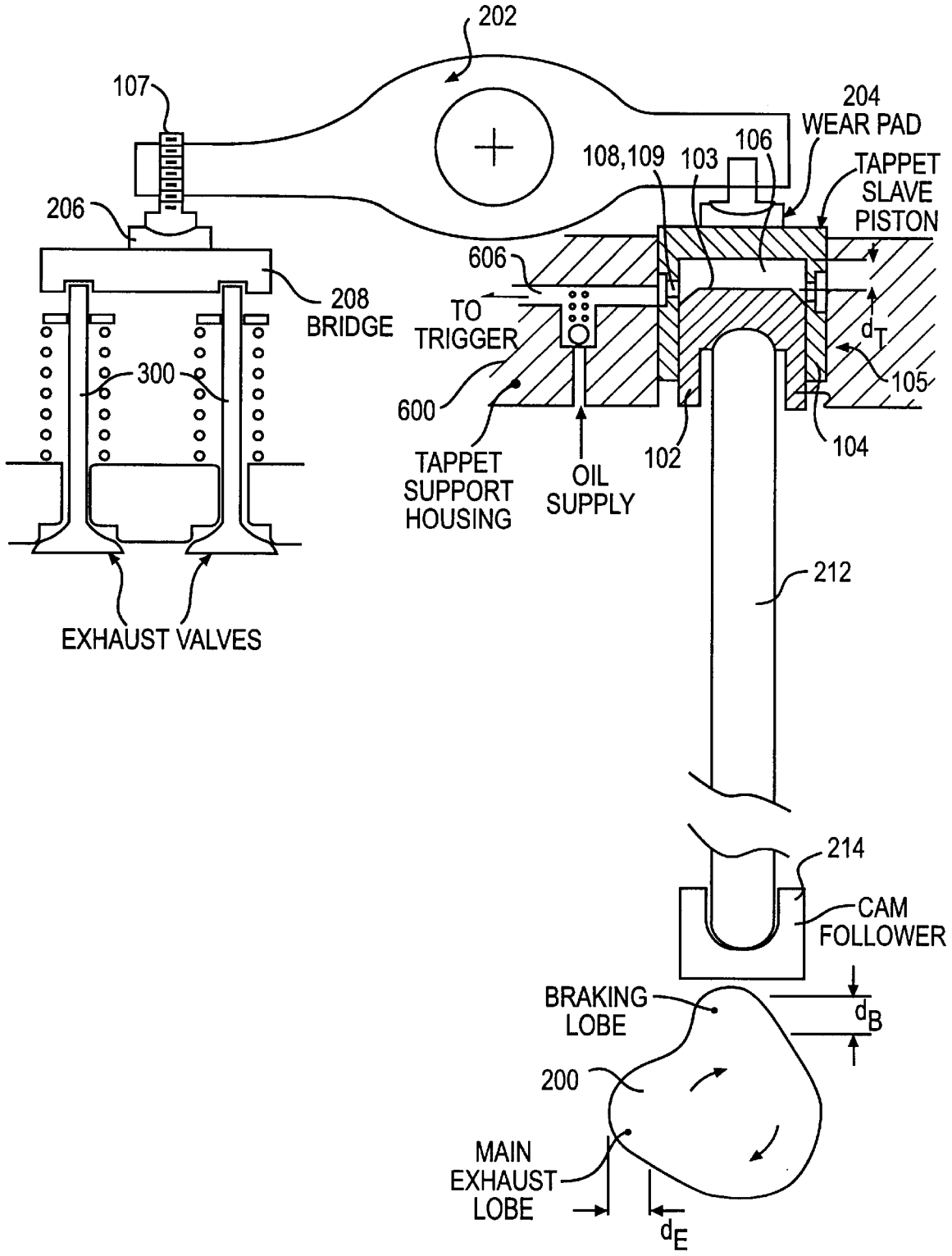
FIG. 3A is a combination schematic and cross-sectional view in elevation of a second alternative embodiment of the invention.

In an alternative embodiment of the invention shown in FIG. 3A, the bottom surface 103 of the master piston 102 is chamfered and the passage 108 through the slave piston 104 is not angled therethrough. Chamfering the master piston may be preferred because it may prevent the feeding and bleeding passages, which communicate with the sealed chamber, from being occluded when the master piston abuts the slave piston.

With renewed reference to FIG. 2A, the master piston 102 may be biased downwardly into the slave piston 104 by a spring 110 so that the absence of hydraulic fluid in the sealed chamber 106 will result in a default setting of the variable length connector 100 to a minimum length corresponding to a maximum amount of lost motion. It follows therefore that should there be a failure in the system which prevents the variable length connector 100 from receiving hydraulic fluid, the valve actuation system will default to a setting of maximum lost motion which results in there being a minimum amount of valve opening. The maximum amount of lost motion may be predetermined to provide some degree of the valve actuation necessary for engine positive power operation, and little or no compression release retarding or exhaust gas recirculation valve actuation. Thee maximum amount of lost motion would thereby allow the engine to produce some level of positive power and possibly some levels of compression release retarding and/or exhaust gas recirculation even with a valve actuation control system failure or variable length connector failure. If the valve actuation system did not default to a maximum lost motion setting, excessive temperatures and pressure could develop in the engine due to uncontrolled compression release retarding and/or exhaust gas recirculation at higher engine speeds if the tappet was left expanded, or no engine function could be obtained if the tappet did not "go solid."

Figure 11A:
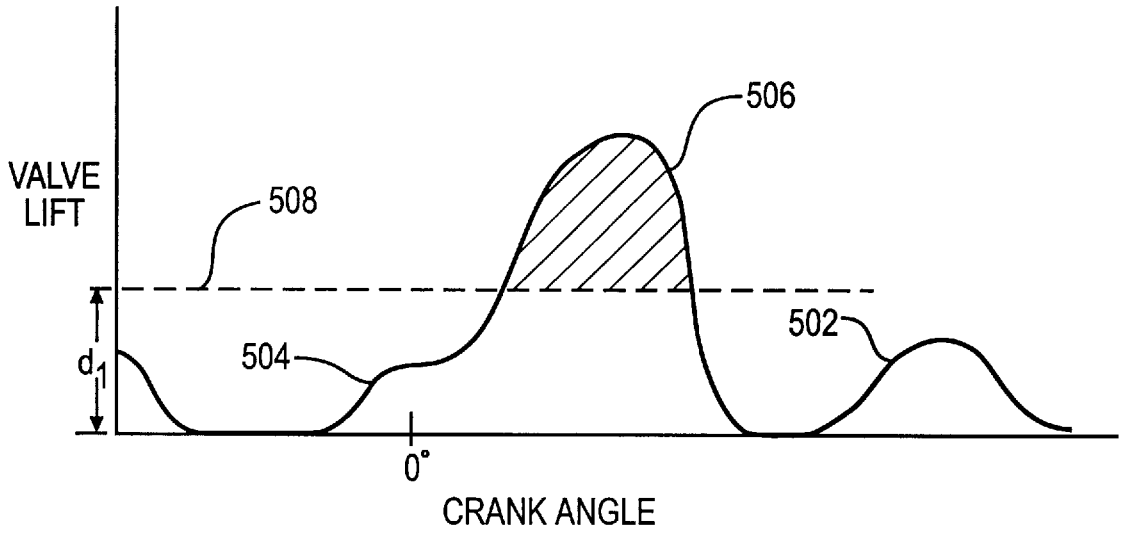
FIG. 11A is a graph of valve lift verses crank angle of a compression release, exhaust gas recirculation, and exhaust valve events for an embodiment of the invention in which fill contraction of the variable length connection means may result in the cutting off of the compression release and exhaust gas recirculation valve events.
Figure 11B:
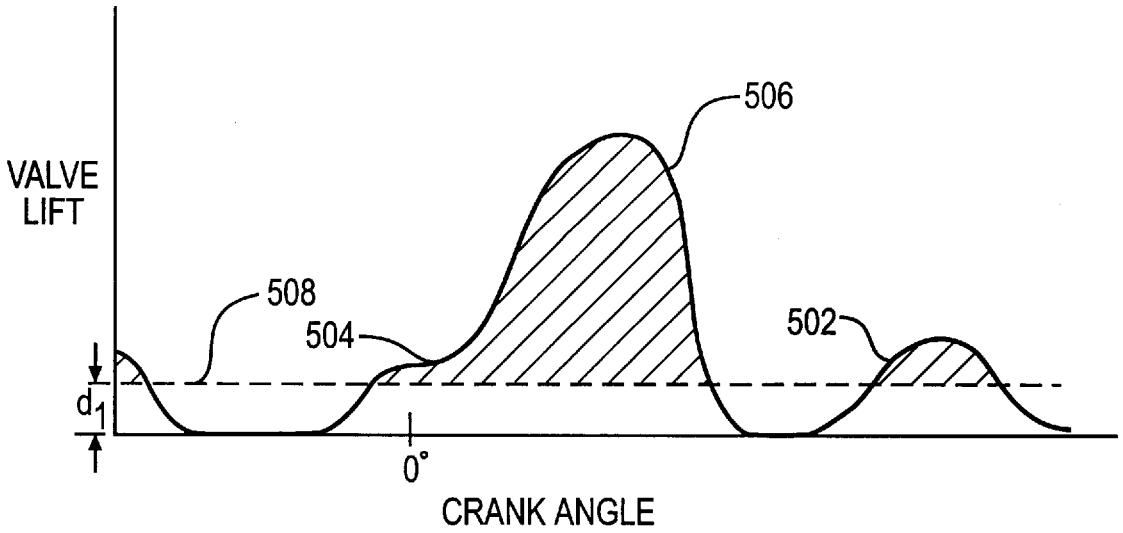
FIG. 11B is a graph of valve lift verses crank angle of a compression release, exhaust gas recirculation, and exhaust valve events for an embodiment of the invention in which full contraction of the variable length connection means may result in a reduction in the magnitude of the compression release, exhaust gas recirculation and exhaust valve events.

FIG. 11A depicts valve lift verses crank angle for an exhaust valve in a four-cycle, engine including a compression release event 502, an exhaust gas recirculation event 504, and an exhaust event 506. If the connector 100 has a variable length of $d_1$, then when the connector is fully contracted, only the exhaust event will be carried out, and that may or may not be reduced in lift and dwell. The contraction of the connector results in the events below the dashed line 508 being "cut off". FIG. 11B depicts a different variable length $d_1$ line 508 which is less severe, and which accordingly results in some exhaust gas recirculation and/or compression release retarding when the connector is fully contracted.

The controller 400 may be used to control the amount of hydraulic fluid in the sealed chamber 106 and thus to control the amount of motion lost by the connector 100. The controller 400 may comprise a trigger valve 410 and an electronic controller 420. The trigger valve 410 may, for example, be similar to the trigger valves disclosed in the Sturman U.S. Pat. No. 5,460,329 (issued Oct. 24, 1995), for a High Speed Fuel Injector; and/or the Gibson U.S. Pat. No. 5,479,901 (issued Jan. 2, 1996) for a Electro-Hydraulic Spool Control Valve Assembly Adapted For A Fuel Injector. The trigger valve may be operatively described as including a passage blocking member 412 and a solenoid 414. The amount of hydraulic fluid in the sealed chamber may be controlled by selectively blocking and unblocking with the blocking member 412, a passage 608 provided in the guide housing 600 for bleeding fluid from the sealed chamber 106 through a passage 109 in the slave piston 104. Passage 109 may be designed similarly to passage 108 in some embodiments, a single passage may provide the function of both passages 108 and 109. Passage 109 may be in constant communication with sealed chamber 106, but not be in constant communication with the passage 608. By unblocking the passage 608, hydraulic fluid may escape from the sealed chamber 106 through passage 610, the variable length connector 100 may be reduced in length, and the amount of lost motion may be increased. Passage 610 may alternatively be connected to the engine crank case (not shown) or to a storage accumulator (not shown). By blocking the passage 608, hydraulic fluid may be trapped in the sealed chamber 106, the connector 100 may increase in length, and the amount of lost motion decreased.

The trigger valve 410 may simultaneously block and unblock the passage 608 leading to the tappet 105 and a second passage 612 leading to a second tappet (not shown). In this manner one trigger valve may control the operation of two (or even more) tappets. This may be preferred since it is expected that the cost of the trigger valve 410 may account for a large proportion of the cost of the valve actuation system 10.

In alternative embodiments, the trigger valve 410 need not be a solenoid activated trigger, but could instead be hydraulically or mechanically activated. No matter how it is implemented, however, the trigger valve 410 preferably is capable of providing one or more opening and closing movements per cycle of the engine and/or one or more opening and closing movements; during an individual valve event.

With continued reference to FIG. 2A, movement of the blocking member 412 may be effected by the solenoid 414, which may rapidly and repeatedly assume an opened or closed position. The solenoid may be controlled by an electronic controller 420, such as an engine control module, which may provide control in response to the levels of measured engine component parameters such as temperature, pressure and engine speed.

Alternative embodiments of the present invention are shown in FIGS. 3–9, inclusive, which are explained below.

In the alternative embodiment of the invention shown in FIG. 3A, the tappet 105 may be disposed intermediate a rocker arm 202 and a push tube 212. In the embodiment of FIG. 3A, the force imparting system 200 comprises a cam. Rotation of the cam 200 may displace a cam follower 214, the push tube 212 and the master piston 102. Dependent upon the amount of hydraulic fluid in the sealed chamber 106, displacement of the master piston 102 may produce a variable amount of displacement of the slave piston 104. Displacement of the slave piston 104 may in turn be transmitted through a first wear pad 204, a rocker arm 202, a second wear pad 206, and a bridge 208 to plural valves 300. The hydraulic feed and bleed passages in the guide housing 600 comprise the same passage in the embodiment of FIG. 3A.

Figure 3B:
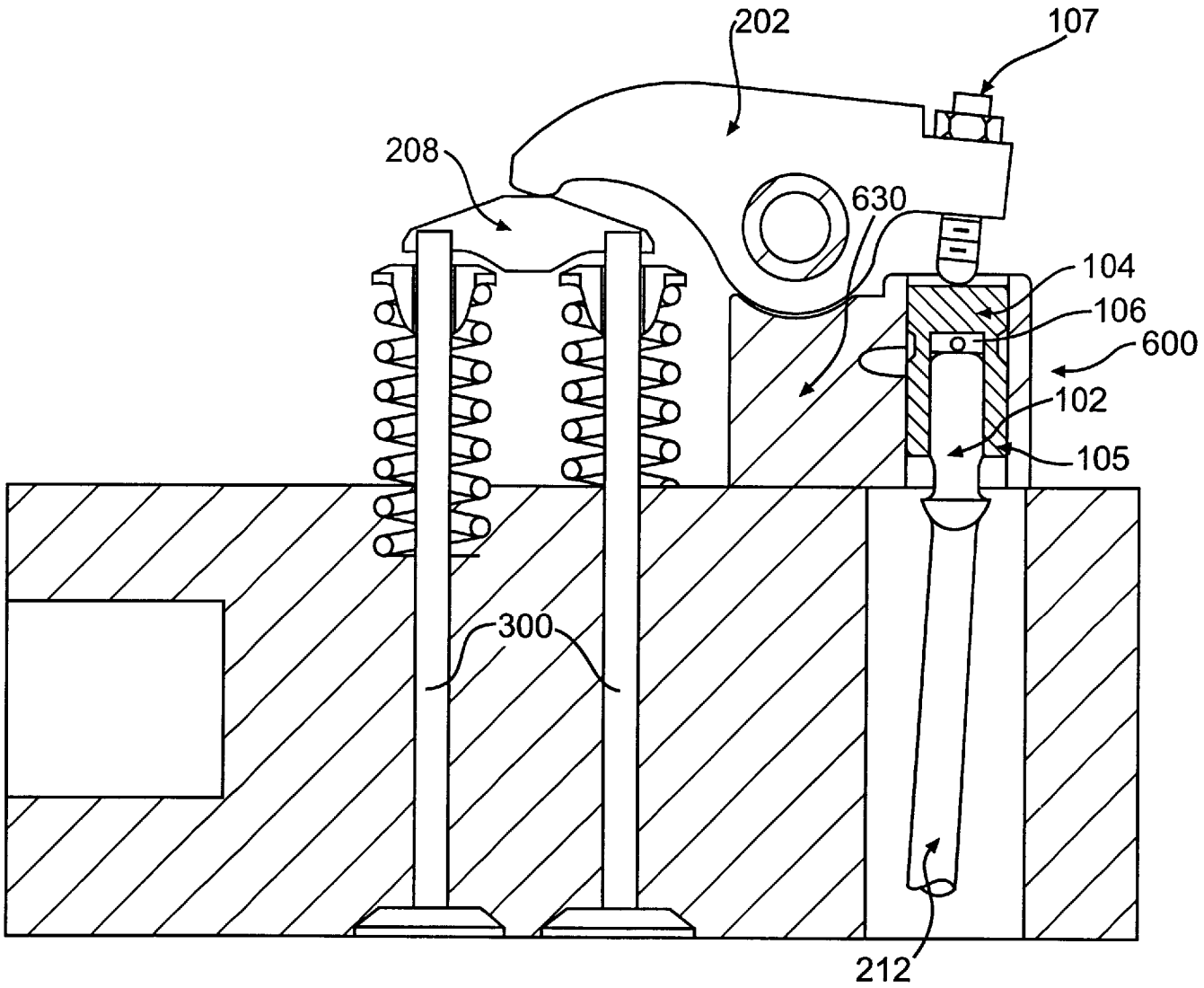
FIG. 3B is a cross-sectional view in elevation of an alternative embodiment of the guide housing shown in FIG. 3A.

FIG. 3B shows a variation of the embodiment of FIG. 3A in which the guide housing, 600 comprises a rocker arm pedestal 630. As in FIG. 3A, the tappet 105 may be disposed intermediate of (i) a lash adjustment means 107 mounted in a rocker arm 202 and (ii) a push tube 212. Vertical movement of the push tube 212 may be used to displace the tappet 105. The amount of push tube movement lost by the tappet 105 may depend on the position of the master piston 102 within the slave piston 104. The position of the master piston 102 within the slave piston 104 may depend in turn upon the amount of hydraulic fluid in the sealed chamber 106.

Figure 3C:
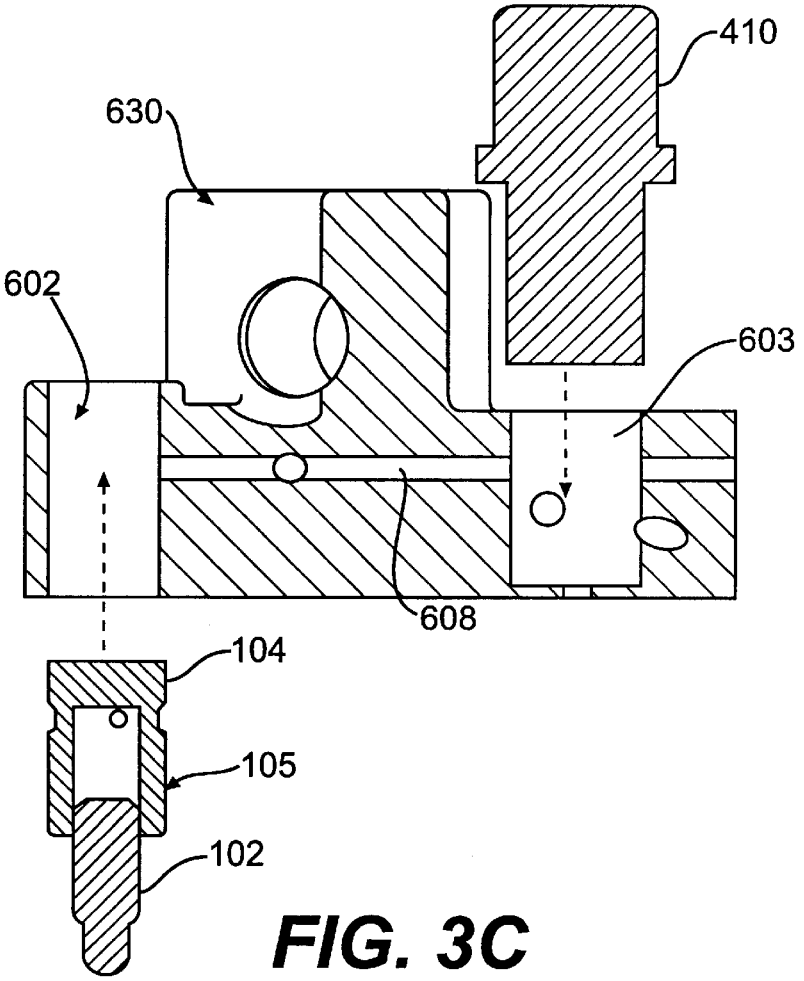
FIG. 3C is a combination cross-sectional and exploded view of the rocker arm pedestal of FIG. 3B.
Figure 3D:
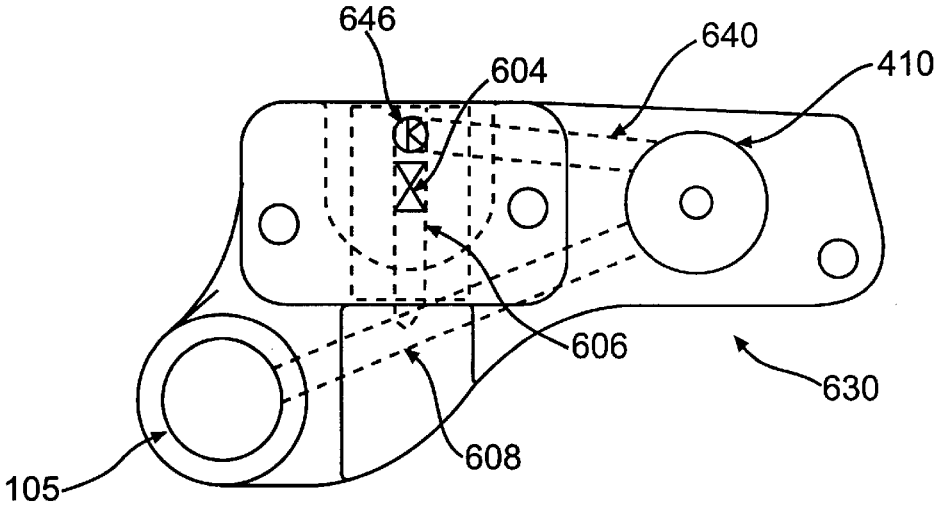
FIG. 3D is a plan view of the rocker arm pedestal of FIG. 3B.

With reference to FIG. 3C, the rocker arm pedestal 630 of FIG. 3B may include a hydraulic fluid feeding and bleeding passage 608 connecting (i) a tappet 105 which may be disposed in a bore 602, and (ii) a high speed trigger valve 410 disposed in a second bore 603. With reference to FIG. 3D, all the necessary hydraulic fluid passages required for the operation of the embodiment of the invention may be included within the rocker arm pedestal 630. Fluid may be supplied from the rocker arm shaft to a passage 646. Fluid supplied by the passage 646 from a low pressure fluid source flows pas a check valve 604 through a passage 606 and 608 and into the tappet 105. When the trigger valve 410 is closed, the fluid supplied to the tappet causes the tappet 105 to expand until the trigger valve 410 is opened and the fluid can drain out through passage 640 to the low pressure source.

Figure 4A:
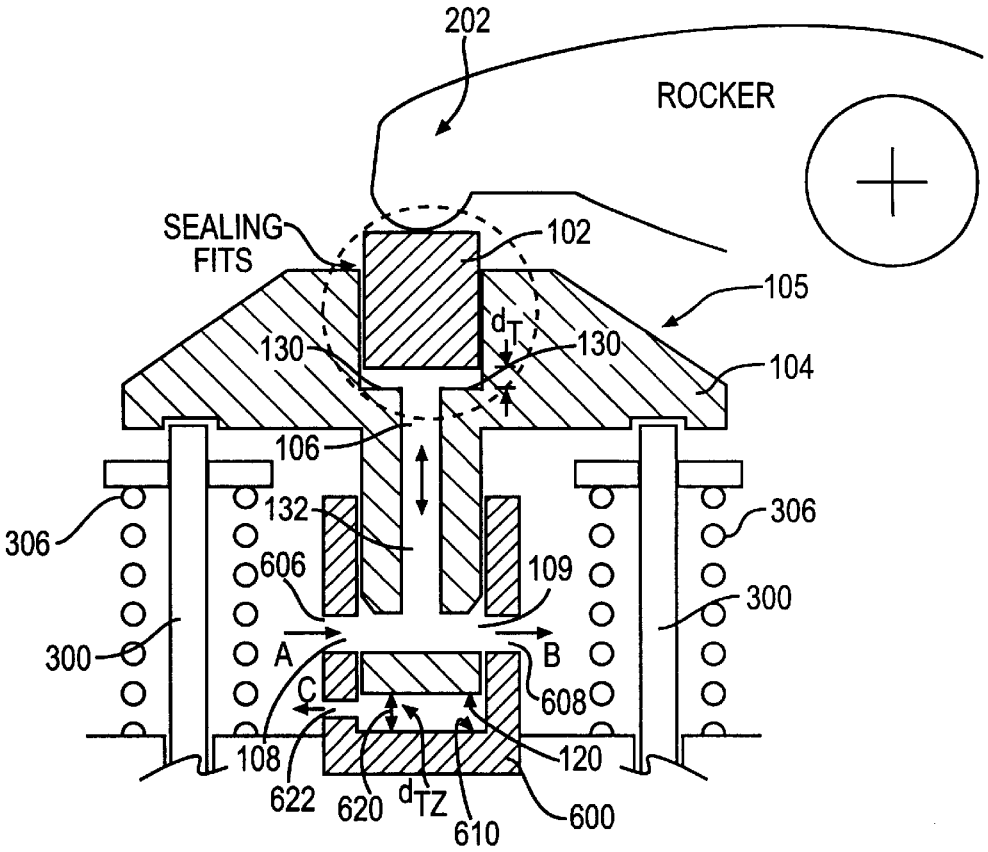
FIG. 4A is a combination schematic and cross-sectional view in elevation of a third alternative embodiment of the invention.
Figure 4B:
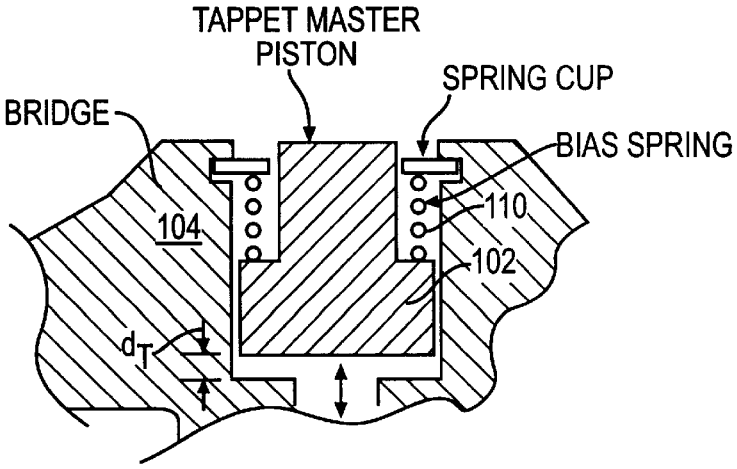
FIG. 4B is a cross-sectional view in elevation of an alternative embodiment of the master piston shown in FIG. 4A.

In the alternative embodiment of the invention shown in FIG. 4A, the tappet 105 also serves as a bridge to activate two or more valves 300 with the movement of a single rocker arm 202. The master piston 102 may engage shoulders 130 provided within the sealed chamber 106. When the tappet 105 is in a fully contracted position, there may be significant amounts of hydraulic fluid in the lower channel portion 132 of the sealed chamber 106. A separate spring within the tappet may not be needed to bias the master piston into a fully contracted position because the master piston 102 may be so biased by the opposing forces of the rocker arm 202 and the valve closing springs 306. FIG. 4B shows a variation of the tappet 105 shown in FIG. 4A in which a spring 110 may be provided to bias the master piston 102 into a fully contracted position.

The tappet 105 in FIG. 4A is disposed in a relatively slender walled guide housing 600, which may include a hydraulic feed passage 606 and a bleed passage 608. The trigger valve connected to the bleed passage 608 is not shown in FIG. 4A. An open air chamber 620 may be formed between a bottom surface 610 of the guide housing 600 and a bottom surface 120 of the slave piston 104 to prevent the slave piston from being prevented from moving vertically within the guide housing 600.

Figure 5:
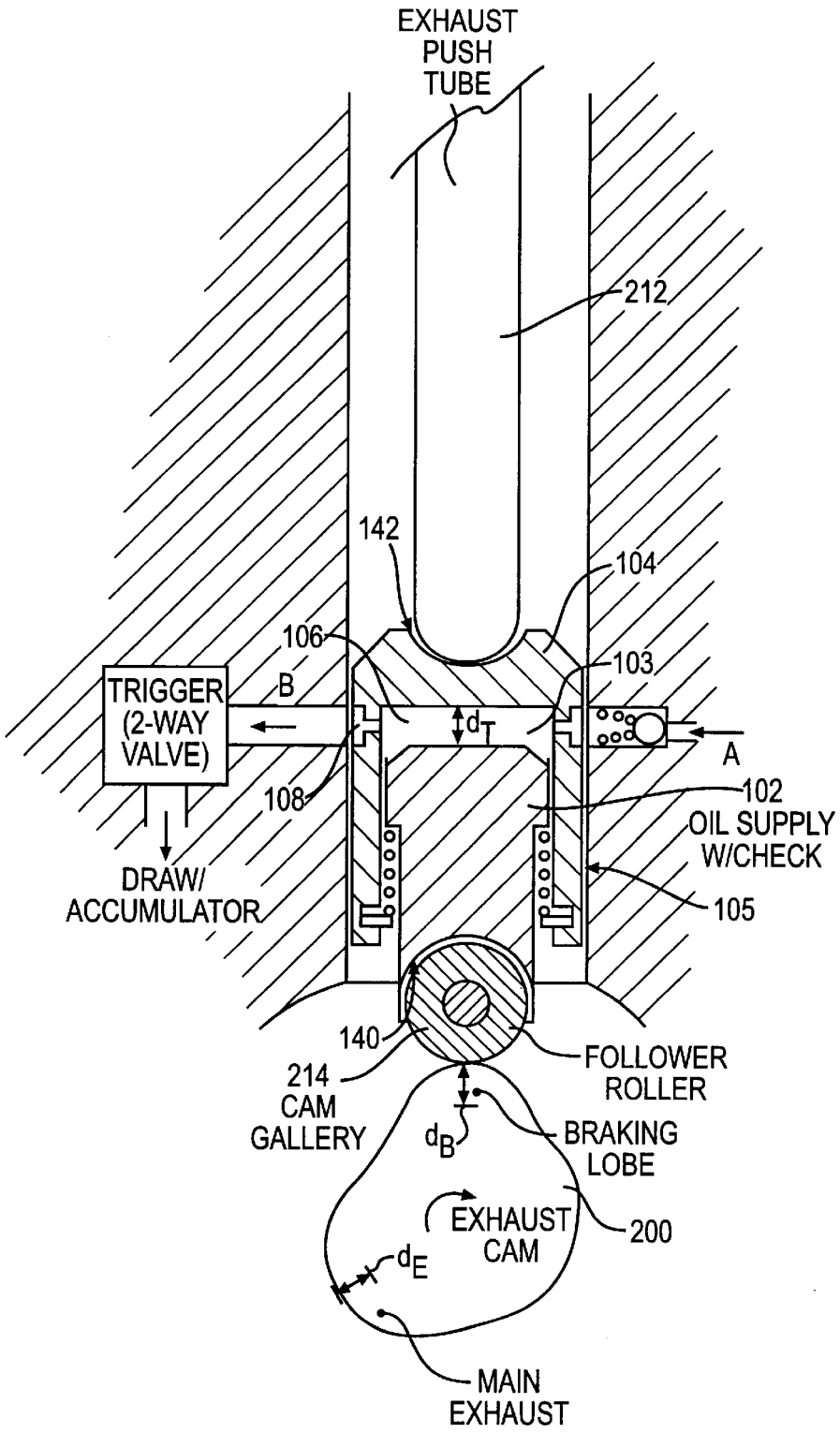
FIG. 5 is a combination schematic and cross-sectional view in elevation of a fourth alternative embodiment of the invention.
Figure 6:
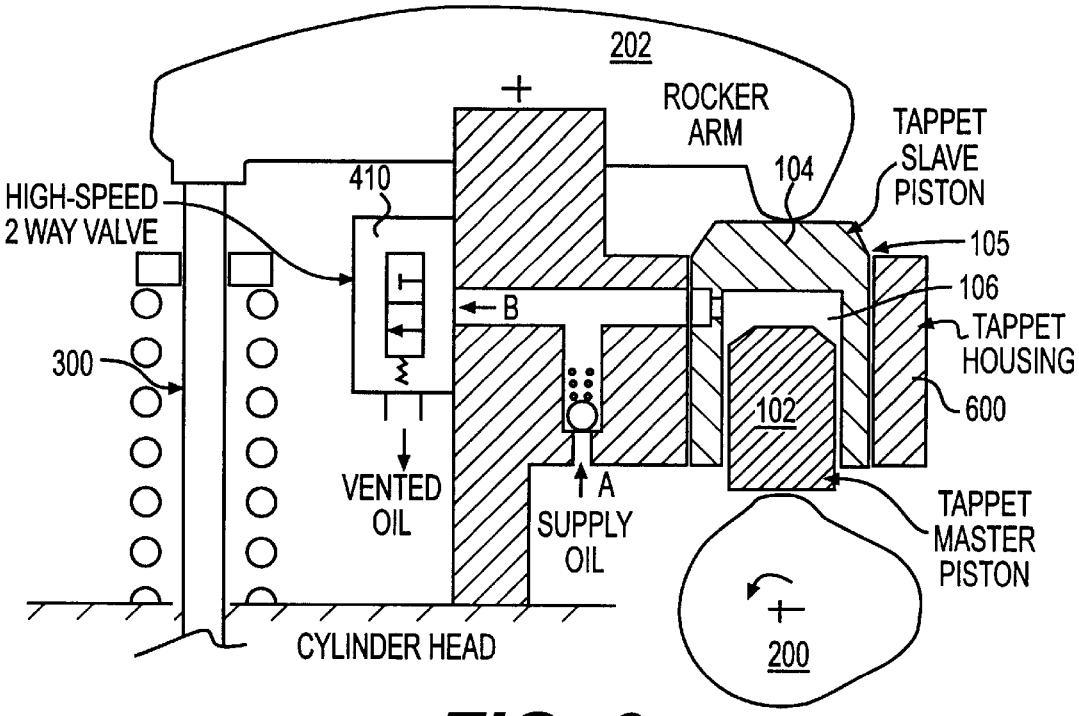
FIG. 6 is a combination schematic and cross-sectional view in elevation of a fifth alternative embodiment of the invention.
Figure 7:
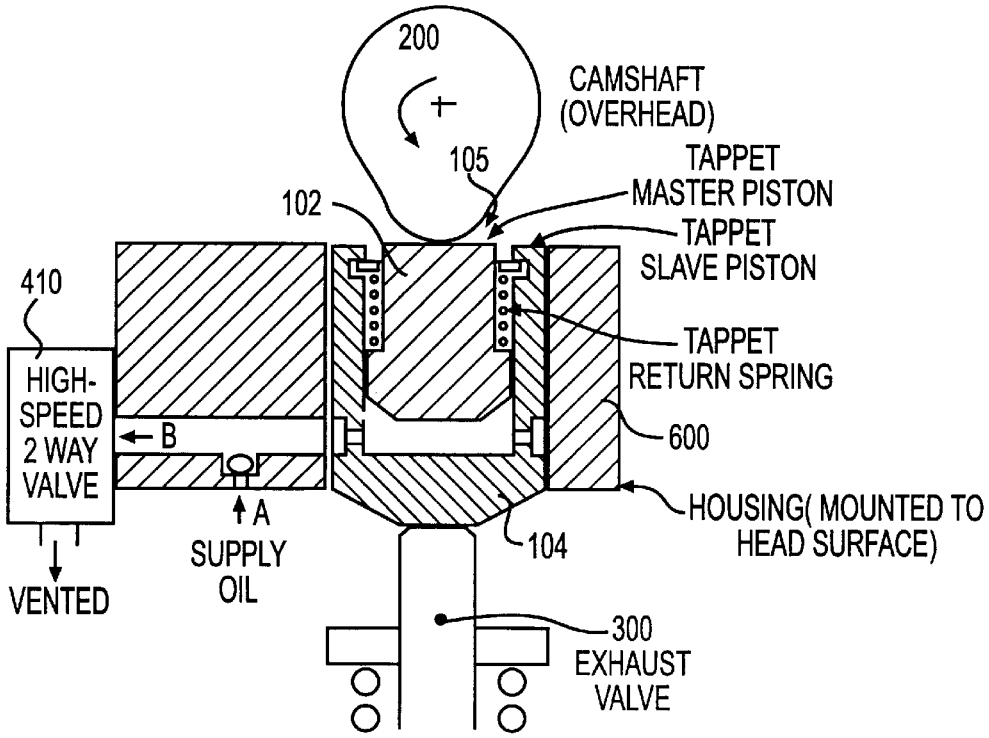
FIG. 7 is a combination schematic and cross-sectional view in elevation of a sixth alternative embodiment of the invention.

In the alternative embodiment shown in FIG. 5, the tappet 105 is shown disposed between a cam follower 214 and a push tube 212. Both the master piston 102 and the slave piston 104 may have dished out surfaces, 140 and 142, respectively, to facilitate engagement of the cam follower 214 and the push tube 212 by each of the pistons 102 and 104. In the alternative embodiment of FIG. 6, the tappet 105 is shown disposed directly between a cam 200 and a rocker arm 202. In the alternative embodiment of FIG. 7, the tappet 105 is shown disposed between a cam 200 and a valve 300. In both FIGS. 6 and 7, a trigger valve 410 may be mounted on or in a guide housing 600 to control the blocking and unblocking of the flow of hydraulic fluid from the tappet 105.

Figure 8:
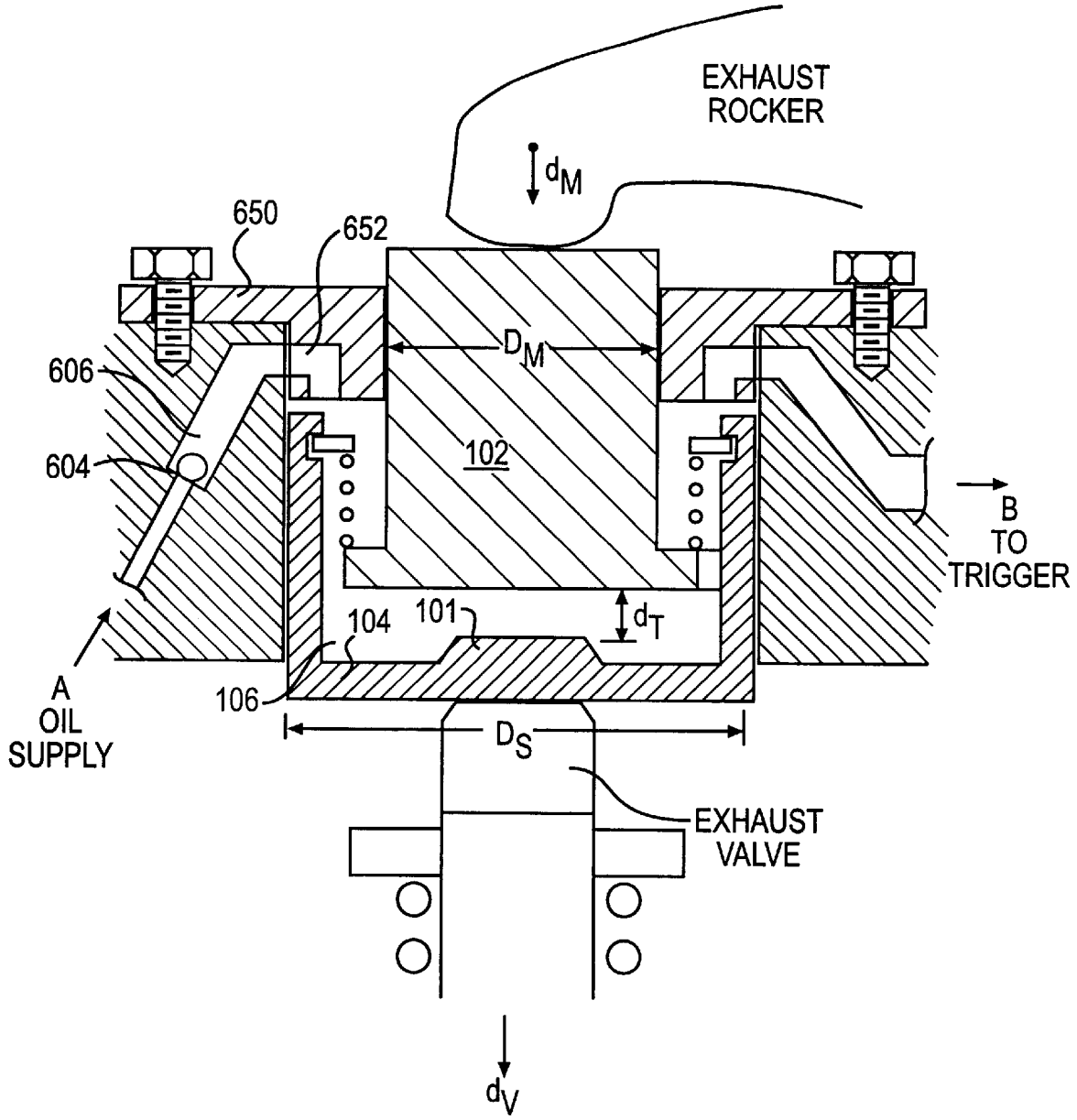
FIG. 8 is a combination schematic and cross-sectional view in elevation of a seventh alternative embodiment of the invention.

In the alternative embodiment of FIG. 8, hydraulic fluid may be provided to the sealed chamber 106 through check valve 604, feeding passage 606, and top feed passage 652 provided in a master piston guide member 650. With regard to the slave piston 104 shown in FIG. 8, an extension 101 may be provided in the bottom of the slave piston to enable mechanical engagement of the slave and master piston while still permitting hydraulic fluid to get between the two pistons.

It should be noted that the hydraulic ratio of the master piston 102 and the slave piston 104 may vary in accordance with the parameters of the engine in which the system is to be used. In order to obtain various hydraulic ratios, the arrangement and relative sizes of the master and slave pistons may vary widely.

Figure 9:
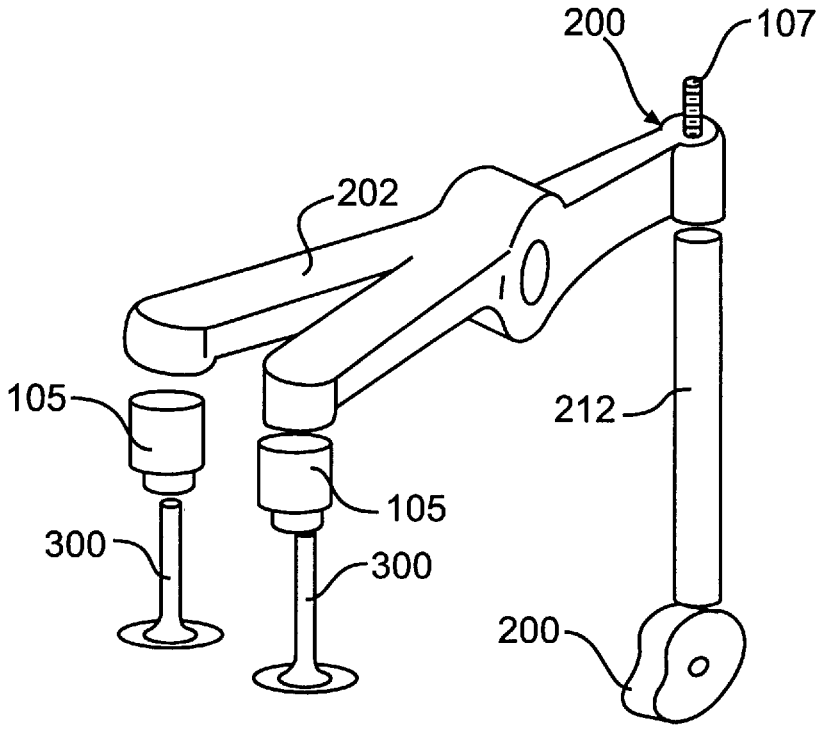
FIG. 9 is a pictorial view of an alternative embodiment of the rocker arms shown in FIGS. 2A, 2B, 3A, 3B, 4A, 4B, 6 and 8.

In the alternative embodiment of FIG. 9, a Y-shaped rocker arm 202 may be used to transmit force from a single force imparting system 200 to two tappets 105 to open two valves 300. FIG. 10 shows a variation of the embodiment of FIG. 9 in which the rocker arm 202 may provide operable connection to two tappets 105 and may provide two lash adjustment means 107.

It will be apparent to those skilled in the art that variations and modifications of the present invention can be made without departing from the scope or spirit of the invention. For example, the variable length connection means used may comprise any functional shape and configuration (e.g. where the larger piston is provided below the smaller piston) provided such connection means are capable of providing a limited amount of lost motion which is greater than zero. Further, such connection means may be located anywhere in the valve train without departing from the intended scopes of the invention. Additionally, it is to be understood that the, invention covers the use of a lost motion system for the activation of exhaust valves, intake valves, auxiliary valves, and/or any other valves providing communication with an engine combustion chamber. Thus, it is intended that the present invention cover the modifications and variations of the invention, provided they come within the scope of the appended claims and their equivalents.

What is claimed is:

1. An internal combustion engine lost motion valve actuation system, comprising:

a variable length connection means for transmitting a valve actuation force from a force source to a valve, said connection means having an internal hydraulic fluid chamber of variable volume and being adapted to assume a predetermined minimum length for providing at least one minimum valve opening event which is greater than zero; and a control means for controlling the length of the variable length connection means, said control means being adapted to vary the length of the connection means one or more times per cycle of said engine by selectively blocking and unblocking a hydraulic fluid drain in communication with said chamber independent of the position of the force source.

2. The system of claim 1 wherein the connection means comprises a variable length tappet that includes the internal hydraulic fluid chamber of variable volume.

3. The system of claim 2 wherein the control means comprises a trigger valve in hydraulic communication with said hydraulic fluid chamber in the tappet.

4. The system of claim 2 wherein said tappet comprises a master piston slidably disposed within a bore of a slave piston such that said chamber is formed between the pistons.

5. The system of claim 4 further comprising a means for biasing said master piston into the slave piston bore to thereby cause the connection means to assume a minimum length.

6. The system of claim 2 wherein said tappet comprises a master piston and a slave piston of unequal diameters.

7. The system of claim 5 wherein the means for biasing comprises a spring.

8. The system of claim 1 wherein said control means causes said connection means to assume a first length when the engine is in a positive power mode and to assume a second length when the engine is in an engine braking mode.

9. The system of claim 3 wherein the control means further comprises an electronic controller operatively connected to said trigger valve.

10. The system of claim 1 further comprising a second variable length connection means for transmitting a valve actuation force to a second valve, the length of which may be controlled by said control means.

11. The system of claim 2 wherein said tappet is disposed between a valve rocker arm and a valve push tube.

12. The system of claim 2 wherein said tappet is disposed between a valve stem and a valve rocker arm.

13. The system of claim 2 wherein said tappet is disposed between a valve push tube and a valve cam.

14. The system of claim 2 wherein said tappet is disposed between a valve rocker arm and a valve cam.

15. The system of claim 2 wherein said tappet is disposed between a valve stem and a valve cam.

16. The system of claim 2 wherein said tappet comprises an outer piston which also serves as a cross head for applying a valve actuation force to two or more valves.

17. The system of claim 1 wherein said control means comprises an electronically controlled solenoid switch.

18. The system of claim 2 wherein said hydraulic fluid comprises oil.

19. The system of claim 1 wherein said control means selectively controls the length of the connection means such that the valve actuation for a compression release valve event is absorbed by the connection means.

20. The system of claim 1 wherein said control means selectively controls the length of the connection means such that the valve actuation for an exhaust gas recirculation valve event is absorbed by the connection means.

21. The system of claim 1 wherein said connection means minimum length enables the valve to be opened for positive power events and reduces the valve lift for a compression release valve event or an exhaust gas recirculation valve event.

22. The system of claim 1 wherein said connection means may be selectively varied in length to individually vary the dwell and lift of one or more events of the group consisting of a positive power valve event, a compression release valve event, and an exhaust gas recirculation valve event.

23. The system of claim 1 further comprising a manually adjustable valve lash adjuster in a valve train intermediate the force source and the valve.

24. The system of claim 4 wherein a bottom surface of said master piston is stepped.

25. The system of claim 4 wherein a bottom surface of said master piston is chamfered.

26. The system of claim 4 further comprising a guide housing in which said slave piston is disposed.

27. The system of claim 26 wherein said guide housing comprises a rocker arm pedestal.

28. The system of claim 27 wherein said control means is disposed in a bore in said rocker arm pedestal.

29. In an internal combustion engine valve actuation system, a hydraulic system for controlling the amount of lost motion between a means for opening an engine cylinder valve and a valve, comprising:

a source of pressurized hydraulic fluid having an outgoing fluid feeding conduit;

a variable length tappet having an internal expansible chamber in communication with the fluid feeding conduit and with a fluid bleeding conduit, and being adapted to assume a minimum operable length; and means for selectively blocking and unblocking said fluid bleeding conduit at a sufficient rate to vary the length of the tappet at least once per cycle of the engine independent of the position of the means for opening the engine cylinder valve, wherein the blocking of the fluid bleeding conduit causes said chamber to retain fluid and expand thereby increasing the length of the tappet and decreasing the amount of lost motion between the means for opening and the valve, and wherein the unblocking of the fluid bleeding conduit causes said chamber to drain off fluid and contract, thereby decreasing the length of the tappet and increasing the amount of lost motion between the means for opening and the valve.

30. The system of claim 29 wherein said means for opening an engine cylinder valve comprises a Y-shaped rocker arm having common operable connection with first and second tappets.

31. An internal combustion engine comprising:

a valve train including a hydraulic linkage operably coupled between an engine cylinder valve and an engine cam, said valve train and hydraulic linkage being provided to transmit a force for opening the valve from one or more lobes on said cam to the valve; and a hydraulic linkage control for selectively controlling the length of said hydraulic linkage to selectively modify the openings of said valve in response to a force transmitted from said cam lobes, said hydraulic linkage control being carried out independent of the position of the engine cam wherein said hydraulic linkage comprises a master piston and a slave piston, each of which are slidably disposed in the hydraulic linkage relative to each other such that the hydraulic linkage may selectively assume plural lengths, and wherein said engine cylinder valve is an exhaust valve and said lobes include one or more of the group consisting of an exhaust lobe, a compression release lobe and an exhaust gas recirculation lobe, and wherein said hydraulic linkage control is responsive to whether said engine is in a positive power mode of operation or a compression release engine braking mode of operation by controlling the length of the hydraulic linkage so that the exhaust valve opens in response to one or more of the group consisting of said compression release lobe and said exhaust gas recirculation lobe only when said engine is in said compression release engine braking mode.

32. In an internal combustion engine valve actuation system, a method of controlling the amount of lost motion between a means for opening an engine cylinder valve and a valve during engine operation, comprising the steps of:

a) providing hydraulic fluid to an internal expansible chamber of a variable length tappet disposed in a valve train linking the means for opening and the valve; and b) selectively bleeding hydraulic fluid from the expansible chamber to decrease the amount of hydraulic fluid in the chamber and decrease the length of the tappet, to thereby increase the amount of lost motion between the means for opening and the valve, wherein the step of selectively bleeding is controlled such that the amount of hydraulic fluid in the chamber may be varied one or more times per cycle of the engine and independently of the position of the means for opening an engine cylinder valve.

33. The method of claim 32 wherein the step of selectively bleeding is controlled such that the tappet is capable of assuming one of three or more different lengths corresponding with different amounts of lost motion.

* * * * *